US007930978B1

(12) United States Patent
Dupont et al.

(10) Patent No.: US 7,930,978 B1
(45) Date of Patent: Apr. 26, 2011

(54) FORWARD FIRING FRAGMENTATION WARHEAD

(75) Inventors: James H. Dupont, Bowie, AZ (US); Henri Y. Kim, Tucson, AZ (US); Travis P. Walter, Tucson, AZ (US); Kim L. Christanson, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 207 days.

(21) Appl. No.: 12/272,044

(22) Filed: Nov. 17, 2008

Related U.S. Application Data

(63) Continuation-in-part of application No. 12/123,158, filed on May 19, 2008.

(51) Int. Cl.
*F42B 12/32* (2006.01)

(52) U.S. Cl. ..... 102/492; 102/506

(58) Field of Classification Search ..... 102/492, 102/494, 475, 506, 515
See application file for complete search history.

(56) References Cited

U.S. PATENT DOCUMENTS

| | | | | | |
|---|---|---|---|---|---|
| 1,272,984 | A | * | 7/1918 | Mutro | 102/494 |
| 3,570,401 | A | | 3/1971 | Euker | |
| 3,646,888 | A | | 3/1972 | Posson et al. | |
| 3,648,610 | A | * | 3/1972 | van Zyl et al. | 102/389 |
| 3,750,587 | A | | 8/1973 | Walde | |
| 3,785,293 | A | | 1/1974 | Barr et al. | |
| 3,818,833 | A | | 6/1974 | Throner | |
| 3,877,383 | A | | 4/1975 | Flatau | |
| 3,968,748 | A | * | 7/1976 | Burford et al. | 102/394 |
| 3,970,005 | A | | 7/1976 | Rothman | |
| 3,974,771 | A | * | 8/1976 | Thomanek | 102/494 |
| 3,977,327 | A | | 8/1976 | Brumfield et al. | |
| 3,978,796 | A | | 9/1976 | Hackman | |
| 4,106,411 | A | * | 8/1978 | Borcher et al. | 102/495 |
| 4,463,678 | A | | 8/1984 | Weimer et al. | |
| H000540 | H | | 11/1988 | Caponi | |
| 4,882,996 | A | | 11/1989 | Bock et al. | |
| H001011 | H | | 1/1992 | Kline | |
| 5,090,324 | A | | 2/1992 | Bocker et al. | |
| 5,157,225 | A | | 10/1992 | Adams et al. | |
| 5,313,890 | A | * | 5/1994 | Cuadros | 102/496 |
| 5,320,044 | A | | 6/1994 | Walters | |
| 5,323,707 | A | | 6/1994 | Norton et al. | |

(Continued)

FOREIGN PATENT DOCUMENTS

DE 3900442 A1 7/1990

(Continued)

*Primary Examiner* — Bret Hayes
*Assistant Examiner* — Reginald Tillman, Jr.
(74) *Attorney, Agent, or Firm* — Eric A. Gifford

(57) ABSTRACT

A forward firing fragmentation warhead is constructed with casing materials that are pulverized upon detonation of the explosive. As a result, the lethality radius of the pulverized case fragments is no greater than that of the gas blast, thus reducing potential collateral damage. Warhead lethality may be improved by forming the fragmentation layer and explosive with dome-shapes that approximately match the shape of the advancing pressure wave. This increases fragment velocity and improves the uniformity of the fragment distribution over the forward-firing pattern. A variable-thickness pattern shaper may be placed between the fragmentation layer and explosive to provide additional shaping of the forward-firing pattern. Warhead weight and cost can be reduced by eliminating explosive at the aft end of the warhead that does not contribute to the total energy imparted to the fragments. More specifically, the aft section of the explosive and explosive containment structure may be tapered to approximately match the expansion of the pressure wave from the single-point aft detonation.

15 Claims, 6 Drawing Sheets

U.S. PATENT DOCUMENTS

| | | | | |
|---|---|---|---|---|
| 5,337,673 | A | 8/1994 | Koontz et al. | |
| 5,419,024 | A | 5/1995 | Koontz et al. | |
| 5,544,589 | A | 8/1996 | Held | |
| 5,594,197 | A * | 1/1997 | Lindstadt et al. | 102/499 |
| 5,668,346 | A | 9/1997 | Kunz et al. | |
| 6,484,642 | B1 * | 11/2002 | Kuhns et al. | 102/493 |
| 6,758,143 | B2 | 7/2004 | Ritman et al. | |
| 7,004,075 | B2 * | 2/2006 | Ronn et al. | 102/473 |
| 2006/0180045 | A1 * | 8/2006 | Ronn et al. | 102/492 |
| 2006/0266247 | A1 | 11/2006 | Gilliam et al. | |

FOREIGN PATENT DOCUMENTS

| | | | |
|---|---|---|---|
| DE | 4011243 | C1 | 5/1996 |
| DE | 4238482 | A1 | 3/1999 |
| DE | 19749168 | A1 | 5/1999 |

* cited by examiner

FORWARD FIRING FRAGMENTATION WARHEAD

CROSS-REFERENCE TO RELATED APPLICATIONS

This application claims benefit of priority under 35 U.S.C. 120 as a continuation-in-part of co-pending U.S. Utility application Ser. No. 12/123,158 entitled "High-Lethality Low Collateral Damage Fragmentation Warhead" and filed on May 19, 2008, the entire contents of which are incorporated by reference.

BACKGROUND OF THE INVENTION

1. Field of the Invention

This invention relates to fragmentation warheads and in particular to a forward firing fragmentation warhead that expels a mass of fragments in a forward-firing pattern.

2. Description of the Related Art

Fragmentation warheads expel metal fragments upon detonation of an explosive. Fragmentation warheads are used as offensive weapons or as countermeasures to anti-personnel or anti-property weapons such as rocket-propelled grenades. The warheads may be launched from ground, sea or airborne platforms. A typical warhead includes an explosive inside a steel case. A booster explosive and safe and arm device are positioned in the case to detonate the explosive.

A radial blast fragmentation warhead includes a steel case that has been pre-cut or scored along the length of the explosive. The booster explosive is positioned in a center section of the case. Detonation of the explosive produces a gas blast that emanates radially from the center point pulverizing the case and expelling the pre-cut metal fragments in all directions in a generally spherical pattern. Although lethal, the radial distribution of the fragments also presents the potential for collateral damage to friendly troops and the launch platform.

A forward blast fragmentation warhead includes a fragmentation assembly placed in an opening in a fore section of the steel case against the flat leading surface of the explosive. The fragmentation assembly will typically include 'scored' metal or individual pre-formed fragments such as spheres or cubes to control the size and shape of the fragments so that the fragments are expelled in a somewhat predictable pattern and speed. Scored metal produces about an 80% mass efficiency while individual fragments are expelled with mass efficiency approaching 100% where mass efficiency is defined as the ratio of fragment mass expelled (therefore effective against the intended target) to the total fragment mass. In other words, the mass efficiency is the ratio of the total mass less the interstitial mass that was consumed during the launch process (therefore ineffective against the intended target) to the total mass.

In the forward blast warhead the booster explosive is positioned in an aft section of the case. The steel case confines a portion of the radial energy of the pressure wave (albeit for a very short duration) caused by detonation of the explosive and redirects it along the body axis of the warhead to increase the force of the blast that propels the metal fragments forward with a lethality radius. The lethality radius is defined as the radius of a virtual circle composed of the sum of all lethal areas (zones) meeting a minimum lethal threshold for a specified threat. These fragments are generally expelled in a forward cone towards the intended target. The density of fragments per unit area is maximum near zero degrees and falls off with increasing angle with tails that extend well beyond the desired cone. As a result, the warhead has a maximum lethality confined to a very narrow angle and expels a certain amount of lethal fragments outside the desired target area that may cause collateral damage. As a result, the aimpoint and detonation timing tolerances to engage and destroy the threat while minimizing collateral damage are tight.

Detonation of the high explosive produces a gas blast that has a much smaller lethality radius in all directions caused by the pressure wave of the blast. The detonation also tears the steel case into metal fragments of various shapes and sizes that are thrown in all directions, beyond the lethality radius of the gas blast. Detonation of the steel case increases the potential for collateral damage to friendly troops and the launch platform.

SUMMARY OF THE INVENTION

The present invention provides a forward firing fragmentation warhead that provides threat lethality and reduced collateral damage.

In an embodiment, the warhead includes an explosive containment structure inside a case. An explosive is placed in the containment structure and an initiator is placed aft of the explosive. Both the case and containment structure are formed of materials that are pulverized upon detonation of the explosive. A forward-firing fragmentation assembly is positioned forward of the explosive to expel fragments in a forward-firing pattern upon detonation of the explosive.

In another embodiment, the warhead includes an explosive containment structure inside a case. An explosive is placed in the containment structure and an initiator is placed aft of the explosive. Both the case and containment structure are formed of materials that are pulverized upon detonation of the explosive. A forward-firing fragmentation assembly is positioned forward of the explosive to expel fragments in a forward-firing pattern upon detonation of the explosive. The fragmentation assembly includes a dome-shaped layer of fragments that is at least approximately conformal with a dome-shaped forward end of the explosive. A pattern shaper may be inserted between the fragmentation layer and the explosive, otherwise they would be conformal. The dome-shape is approximately matched to the shape of the front of the pressure wave that reaches the fragmentation assembly upon detonation. This increases fragment velocity and expels the fragments in a more uniform pattern.

In another embodiment, the warhead includes an explosive containment structure inside a case. The containment structure has a forward section with a diameter conformal with the forward section of the case and has a tapered aft section that tapers to a reduced diameter to define a tapered void space between the case and the containment structure. An explosive is placed in the containment structure and an initiator is placed aft of the explosive. Both the case and containment structure are formed of materials that are pulverized upon detonation of the explosive. A forward-firing fragmentation assembly is positioned forward of the explosive to expel fragments in a forward-firing pattern upon detonation of the explosive. Upon detonation a pressure wave propagates forward through the tapered explosive to the diameter of the case. The taper may be optimized to match the expansion of the pressure wave thereby maximizing the void space without reducing the total explosive energy imparted to the fragmentation assembly. The elimination of explosive reduces both the cost and weight of the warhead.

These and other features and advantages of the invention will be apparent to those skilled in the art from the following detailed description of preferred embodiments, taken together with the accompanying drawings, in which:

DETAILED DESCRIPTION OF THE INVENTION

The present invention describes a high-lethality low collateral damage forward firing fragmentation warhead. The reduction in collateral damage is accomplished by forming the case of a material that is pulverized upon detonation of the explosive. As a result, the lethality radius of the pulverized case fragments is no greater than that of the gas blast, thus reducing potential collateral damage. Warhead lethality may be improved by forming the fragmentation layer and explosive with a dome-shape that approximately matches the shape of the front of the pressure wave. This increases fragment velocity and improves the uniformity of the fragment distribution over the forward-firing pattern. A variable-thickness pattern shaper may be placed between the fragmentation layer and explosive to provide additional shaping of the forward-firing pattern. Warhead weight and cost can be reduced by eliminating explosive at the aft end of the warhead that does not contribute to the total energy imparted to the fragments. More specifically, the aft section of the explosive and explosive containment structure may be tapered to approximately match the expansion of the pressure wave from the single-point aft detonation.

The forward firing fragmentation warhead was developed as a short-range, low-speed countermeasure for land-based launch platforms (e.g. tanks or personnel carriers) to intercept and destroy threats such as rocket-propelled grenades (RPGs) while minimizing the risk of collateral damage to friendly troops. The fragmentation warhead is however adaptable to a wide-range of battle field scenarios to include any type of land, sea, air or spaced-based launch platforms and longer-range, higher-speed engagements. The warhead may be configured for use as an offensive weapon or for countermeasures.

The fragmentation warhead can be used in conjunction with a wide range of interceptors including projectiles and self-propelled missiles and spinning or non-spinning and with various guidance systems. The aiming and detonation sequence may be computed and loaded into the interceptor prior to firing. For example, in a close-range countermeasure system, the fire control computer will determine when to fire a sequence of motors on the interceptor and when to detonate the warhead. This sequence is loaded into the interceptor prior to launch. A more sophisticated longer range missile might fly to a target and compute its own aiming and detonation sequences or have those sequences downloaded during flight.

Figure 1:
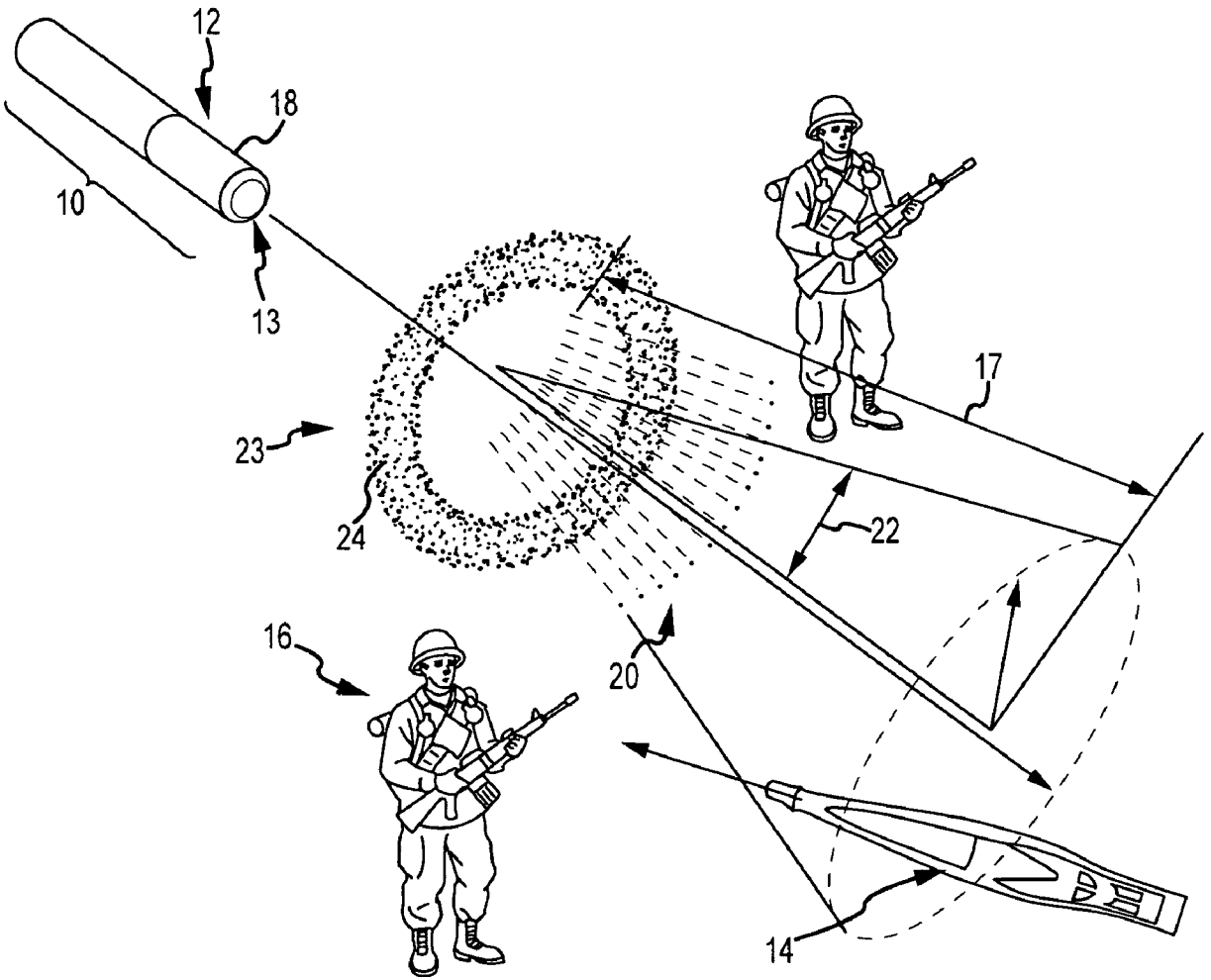
FIG. 1 is a diagram illustrating the blast pattern of the forward firing warhead to engage a threat without collateral damage to friendly troops.

As shown in FIG. 1 of an exemplary countermeasures system, an interceptor 10 including a fragmentation warhead 12 having a fragmentation assembly 13 is fired to engage and destroy a threat depicted as a rocket-propelled grenade 14 in close proximity to friendly troops 16. The warhead must destroy the threat with a high likelihood of success and minimize the threat of collateral damage to the troops or, more generally, to any person or object other than the engaged threat. The aiming and detonation sequence are loaded into the interceptor and is fired at threat 14. The warhead is detonated at a standoff distance 17 to expel metal fragments 20 from fragmentation assembly 13 in a prescribed half-angle 22 of a forward-firing pattern to destroy the threat. The forward-firing pattern suitably occupies a half-angle of between 3 and 45 degrees about a long axis of the warhead.

The threat detection, guidance, navigation and control systems are input to the fire control computer generate a firing solution to destroy the threat. That solution has a composite system error which means there is an aiming error that can be translated into an area or volume. The area or volume of the cone is typically 100 to 1,000 times larger than the presented area of the target. The fragmentation warhead must engage the entire area or volume with lethal force to destroy the threat. The area or volume and the lethality requirement per threat determine the number of fragments that must be expelled. Typically the threat can be in any place within the volume with equal probability. In this case, the fragmentation warhead is suitably designed to expel metal fragments having a somewhat uniform pattern density (# fragments per unit area) over the prescribed solid angle of the volume and preferably no further.

To accomplish the dual objectives of improved lethality and reduced collateral damage, the end of the explosive and the fragmentation assembly 13 are suitably formed with largely conformal dome shapes that approximately match the shape of the advancing pressure wave. This both increases the amount of explosive energy delivered to those fragments to increase their velocity and serves to expel them in a desirable pattern (e.g. half-angle and uniformity of fragment density over the half-angle). A variable-thickness pattern shaper may be inserted between the explosive and fragment layer to slow portions of the wave front to further shape the forward-firing pattern. The case 18 is formed of a material such as a fiber reinforced composite, engineered wood, thermoplastic (resin, polymer), or even foam that is pulverized into a cloud 23 of harmless fine particles 24 upon detonation of the explosive. The particles preferably have a mass efficiency near 0% and no greater than 1% so that the lethality radius of the expelled particles 24 is no greater than the lethality radius of the gas blast from the detonating explosives. Consequently, the threat to the soldiers on either side of the warhead is reduced to the threat posed by the gas blast. For typical countermeasure sized warheads this is a couple meters. Additionally, warhead weight and cost can be reduced by eliminating explosive at the aft end of the warhead that does not contribute to the total energy imparted to the fragments. More specifically, the aft section of the explosive and explosive containment structure may be tapered to approximately match the expansion of the pressure wave from the single-point aft detonation.

Figures 2A, 2B:
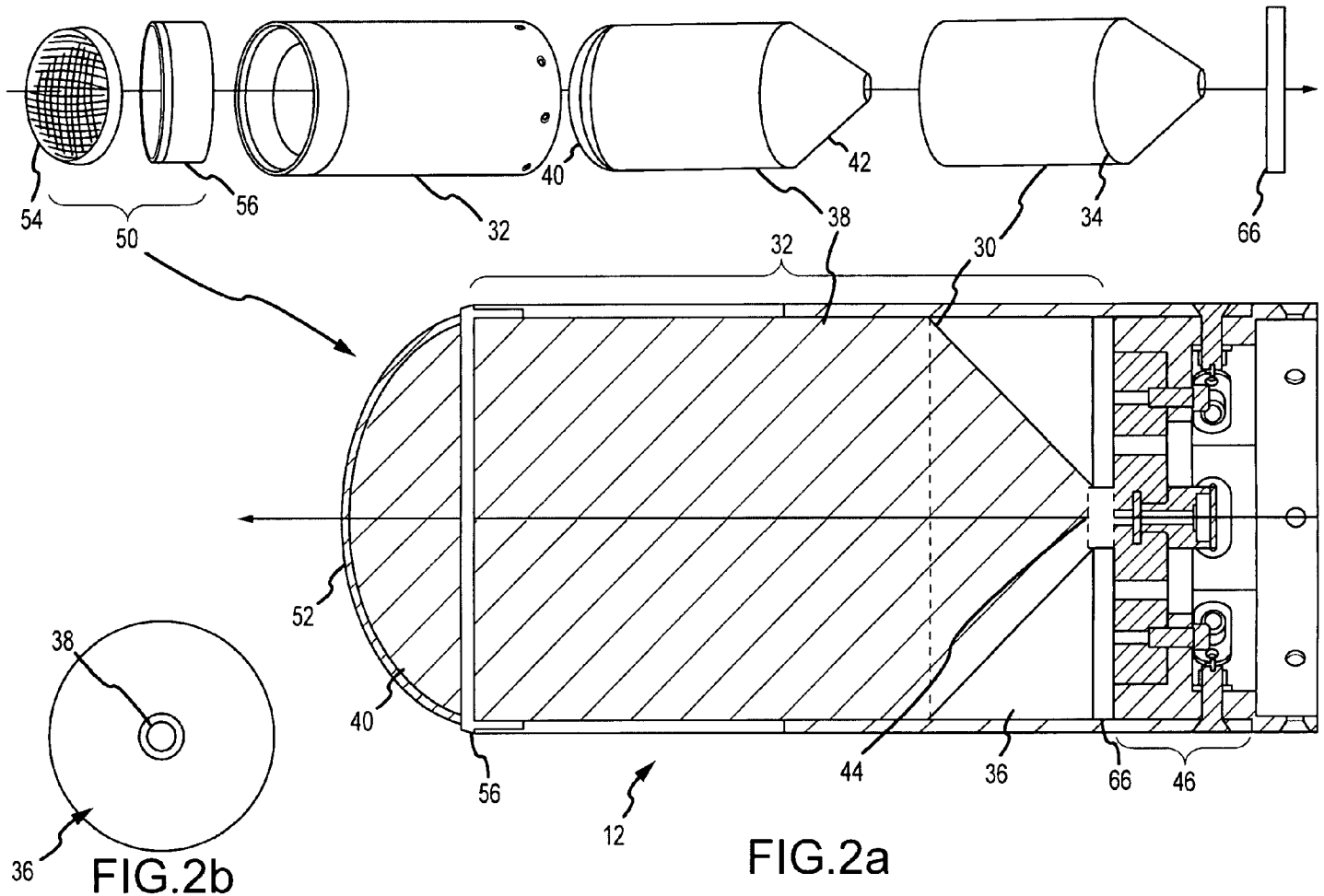
FIGS. 2*a* and 2*b* are diagrams of a section and exploded view and a bottom view of the warhead.

As shown in FIGS. 2*a* and 2*b*, an embodiment of forward firing warhead 12 includes an explosive containment structure 30 placed inside a case 32. A tapered aft section 34 of the containment structure defines a tapered void space 36 between the case and the containment structure. An explosive 38 having a fore section with a diameter conformal with the case and a dome-shape end 40 and a tapered aft section 42 is fit inside the containment structure. The dome-shaped end 40 of the explosive suitably extends beyond an opening in the containment structure and case. An initiator 44 (a small booster charge) placed aft of the explosive initiates detonation of the explosive at the end of the taper. This type of single-point detonation is typical for these types of warheads. Other multi-point configurations may be used. A safe and arm device 46 is positioned to ignite the booster when commanded. The containment structure and case are formed of materials such as a fiber reinforced composite, engineered wood, thermoplastic (resin, polymer), or even foam that are pulverized with a mass efficiency suitably no greater than 1% upon detonation of the explosive. As a result, the pulverized case material suitably has a lethality radius to humans no greater than the lethality radius due to the pressure wave of the detonated explosive.

A forward-firing fragmentation assembly 50 is positioned in the opening around the dome-shaped end of the explosive. The assembly suitably includes a dome-shaped layer 52 of metal fragments 54 that are expelled in the forward-firing pattern with a mass efficiency of at least 70% upon detonation of the explosive. Pre-formed fragments are generally preferred because they have a known size and shape upon detonation and retain a mass efficiency near 100%. The fragments may be shaped (rectangular, square or other unique shapes) for a particular threat. For ease of assembly the fragments are typically formed in a mold held by an epoxy that is pulverized on detonation.

In a forward firing fragmentation assembly, the warhead and fragmentation assembly are preferably configured to control the velocity of the expelled fragments, the half-angle of the pattern and the uniformity of the density of the expelled fragments over the half-angle. In the forward-firing fragmentation assembly 50 the provision of a dome-shaped explosive 38 and a dome-shaped layer 52 of fragments effectively addresses all three parameters. First, in a conventional warhead of this type an aerodynamic nose cone is placed over the flat leading surface of the warhead to provide aerodynamic stability. At typical velocities for short-range countermeasures, a semi-blunt or dome shape is used. In this embodiment, the explosive is extended to fill the dead space and the conformal fragment layer provides the aerodynamic surface. The additional explosive volume upon detonation imparts greater total energy to the fragments thereby increasing their velocity. Second, as the simulation results will show the curvature of the dome is suitably selected to approximately match the shape of the pressure wave. As a result, the metal fragments are expelled in a well-defined cone with improved density uniformity. In higher velocity warheads, the explosive and fragmentation layer may be shaped to match the front of the pressure wave and a more pointed aerodynamic nose cone place over the warhead for aerodynamic considerations.

A containment ring 56 may be placed around the periphery and aft of the dome-shaped layer. This ring provides a degree of confinement of the pressure wave to direct fragments axially instead of radially. The ring contains the explosive blast momentarily (e.g. a few microseconds) but long enough to direct the pressure wave in a forward direction before the ring is itself pulverized. The ring contributes to reducing or eliminating any tails of the pattern beyond the prescribed half-angle. The ring may be extended forward to provide additional confinement to narrow the half-angle as desired. The ring could be extended to span the entire length of the case. A variable-thickness pattern shaper may be inserted between the explosive and fragment layer to slow portions of the wave front to further shape the forward-firing pattern. A base plate 66 may be placed between the assembly and the safe and arm device to reflect the energy of the pressure wave forward.

One might assume that the removal of a portion of explosive 38 to create the tapered void space would reduce the total energy imparted to the forward-firing fragmentation assembly and degrade the lethality of the weapon. However, as the simulations will demonstrate, for an L/D (length/diameter) optimized forward-firing aft-initiated warhead a tapered aft portion of the explosive represents "dead" volumetric space. In other words, explosive in that space does not contribute to the total energy in the forward propagating wave. Essentially the single-point detonation expands as the pressure wave moves forward until it fills the diameter of the casing. Suitably, the taper of the containment structure and explosive are optimized for a given warhead to maximize the tapered void space without reducing the total energy in the forward propagating pressure wave. Warhead weight and cost is reduced by eliminating explosive at the aft end of the warhead that does not contribute to the total energy imparted to the fragments. Tapering of the aft section of the explosives is however optional, a conventional cylindrical design may be used with the dome-shaped fragmentation assembly.

Figure 3A:
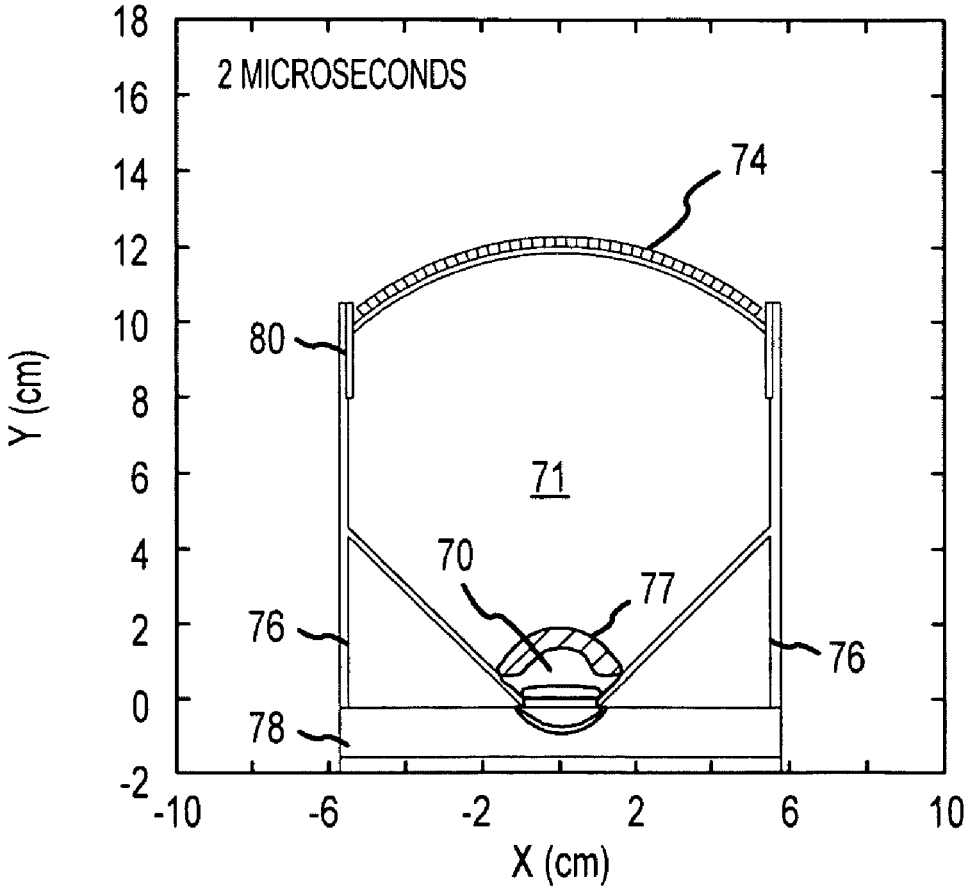
FIGS. 3*a* through 3*c* are plots of the gas blast propagation to expel the fragments in the forward-firing pattern.
Figure 3B:
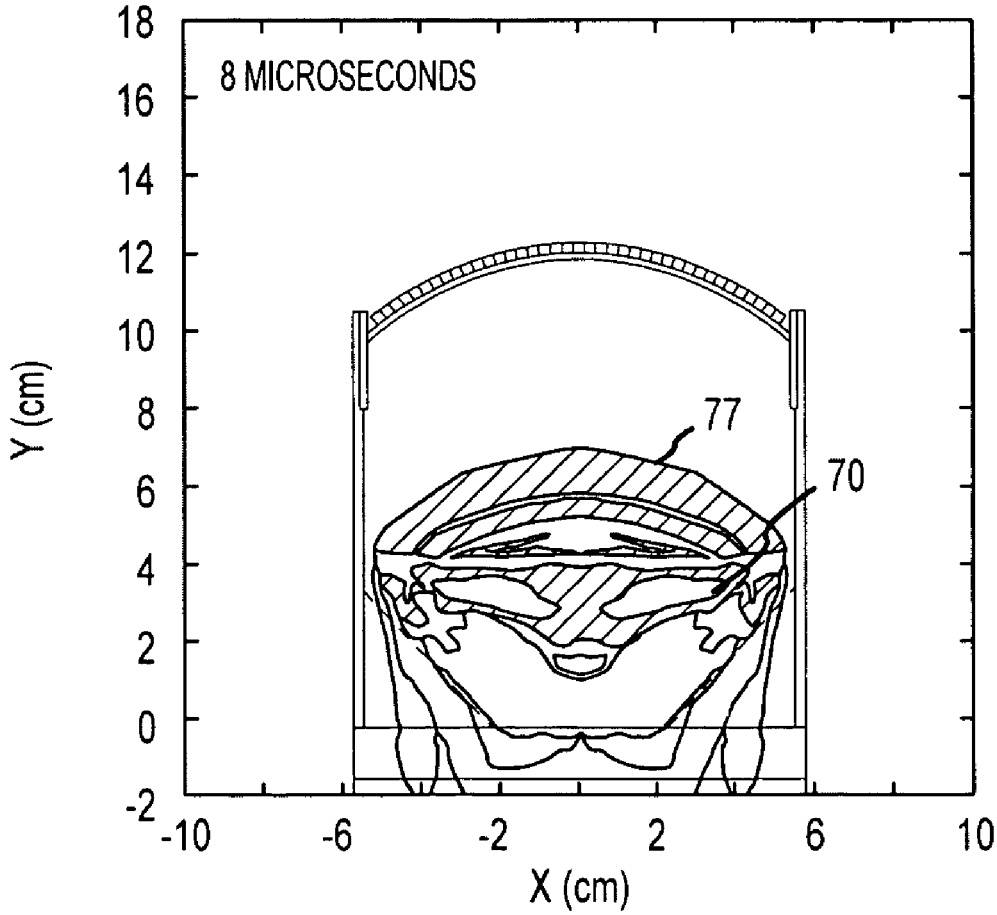
Figure 3C:
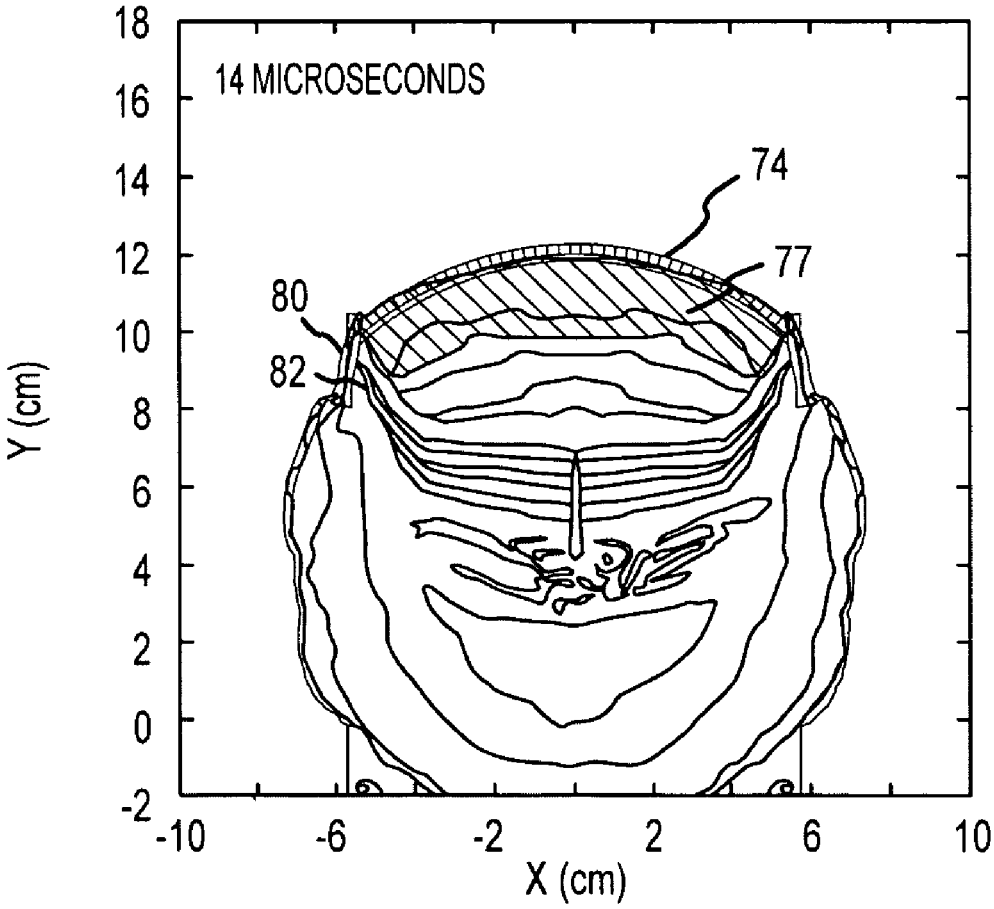

In warhead analysis, the detonation pressure wave is simulated using CTH analysis models. FIGS. 3*a* through 3*c* show the detonation pressure wave 70 from detonation of an explosive 71 through expulsion of the metal fragments in the forward-firing pattern. The CTH analysis models a forward firing warhead 72 that includes a dome-shaped layer 74 of pre-formed fragments and an aft tapered void space 76. The curvature of the dome-shaped layer conforms to the front 77 of the pressure wave. A base plate 78 is positioned aft and a containment ring 80 is around the periphery of the dome-shaped layer. The design of the explosive is optimized to a warhead's length to diameter ratio. In this case L/D=1 and the taper is 45 degrees. For a forward firing warhead, increasing the length much beyond an L/D of 1 (i.e. L/D>1) produces only incremental improvements in the fragment velocity or warhead lethality against the threat. However, should the L/D be >1, the taper angle can be increased to optimize for an explosive length of 1 (or L/D of 1), thus reducing the explosive content for cases where L/D>1.

As shown in FIG. 3*a* at t≈2 microseconds, the front 77 of pressure wave 70 moves forward from the single initiation point through the taper and expands to fill the taper as it advances. The highest pressure exists at the wave front 77. The pressure in the aft section is much lower.

As shown in FIG. 3*b* at t≈8 microseconds, the front 77 of pressure wave 70 has expanded to the diameter of the explosive at the opposing end of the taper.

As shown in FIG. 3*c* at t≈14 microseconds, the high pressure wave front 77 has reached the dome-shaped layer 74. The shape of the wave front substantially conforms to the shape of the layer. Containment ring 80 momentarily confines the pressure wave in region 82 thereby directing the pressure wave forward. At this point, the casing materials have begun to pulverize and the forward-firing fragment layer 74 will be expelled instantaneously.

The CTH analysis models clearly demonstrates (a) that the proper tapering of the explosive and containment structure to create the void space does not degrade the forward energy of the pressure wave and (b) that conforming the shape of the forward-firing fragmentation layer and explosive to the shape of the pressure wave front increases fragment velocity and pattern uniformity. Other warhead configurations and configurations of the forward firing fragmentation assembly may be employed within the scope of the forward firing warhead architecture.

Figure 5:
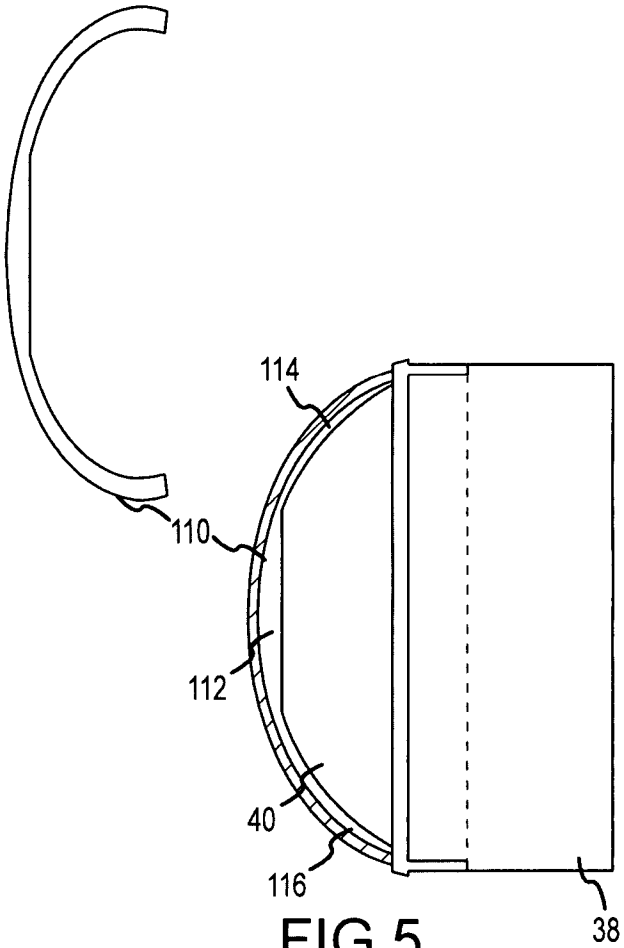
FIGS. 4 and 5 are diagrams of embodiments of the forward-firing fragmentation assembly including an extended containment ring and pattern shaper, respectively, to control the half-angle of the forward-firing pattern.
Figure 4:
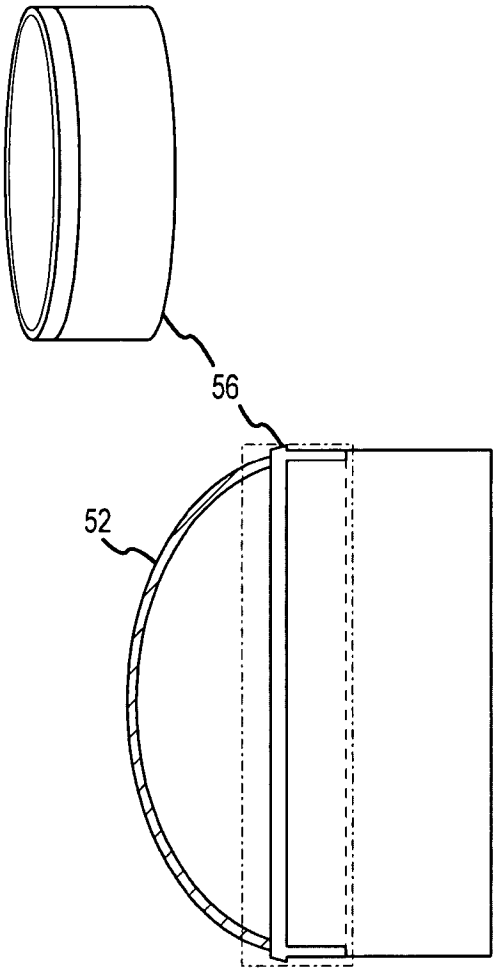

Different embodiments of the forward-firing fragmentation assembly are depicted in FIGS. 4 through 5. As shown in FIG. 4, the length of containment ring 56 is extended forward to overlap a portion of dome-shaped layer 52. In this configuration, the configuration ring will contain the pressure wave, directing the front of the wave in the forward direction thereby reducing the half-angle of the forward firing pattern.

A shown in FIG. 5, a variable-thickness pattern shaper 110 is placed between the end 40 of explosive 38 and dome-shaped layer 52 to augment the pattern shaping. Note, in this particular embodiment the dome-shaped end 40 of explosive 38 is flattened in the center 112 and only approximately conformal with dome-shaped layer 52. The pattern shaper 110 is conformal with the dome-shaped layer. The explosive is still considered to have a "dome-shape". As the pressure wave reaches pattern shaper 110 it travels relatively faster in the peripheral regions 114 and 118 on either side of the center 112 because explosive 38 continues to detonate. Once the wave goes through the thickest part of the pattern shaper it slows down more than the wave going through the thinnest part. The result is that the pattern shaper slows down the center fragments and focuses the fragments, more in a straight line. How much the wave slows down is dictated by the shock impedance of the shaper material which is a function of the material's density and the speed of sound in the material and the thickness of the pattern shaper. Lower density materials such as composites are generally preferred because they absorb less energy. However, higher density materials can have a smaller volume leaving more space for explosive. The range of materials suitable for the shaper includes fiber reinforced composites, thermoplastic (resin, polymer), nylon, rubber, stereolithographic (SL) materials, structural foams, and metals. The only qualification is that it be either castable or machinable. In general, we want to minimize or even eliminate any material between the explosive and the fragmentation layer to maximize the energy imparted to the fragments. However, in some cases the pattern shaper may provide the optimal balance of pattern shape and uniformity with velocity. Other shapes and designs of the variable-thickness pattern shaper are possible to achieve different patterns and to address different threat scenarios.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A forward firing warhead, comprising:

a case;

an explosive containment structure inside the case, said case and containment structure formed of materials that are pulverized upon detonation eliminating metal fragments thrown radially from the warhead;

an explosive in the explosive containment structure that is in conformal contact with an inner surface of the containment structure, said explosive having a dome-shaped forward section;

an initiator aft of the explosive to initiate detonation of the explosive to produce a pressure wave; and a forward-firing fragmentation assembly including a dome-shaped fragmentation layer positioned forward of the explosive, the curvature of said dome-shaped fragmentation layer approximately conforming to the shape of the front of the pressure wave that reaches the fragmentation assembly to expel fragments in a forward-firing pattern.

2. The forward firing warhead of claim 1, wherein said fragmentation layer comprises pre-formed fragments.

3. The forward warhead of claim 2, wherein the forward-firing fragmentation assembly comprises:

a containment ring around the periphery and aft of said dome-shaped layer.

4. The forward warhead of claim 3, wherein the containment ring overlaps at least an aft portion of the dome-shaped layer.

5. The forward warhead of claim 2, further comprising a variable-thickness pattern shaper between and in conformal contact with the dome-shaped fragmentation layer and the dome-shaped forward section of the explosive, said pattern shaper shaping the front of the pressure wave as it propagates through the pattern shaper.

6. The forward warhead of claim 5, wherein the pattern shaper is thicker in a central region than in a peripheral region to slow the central region of the pressure wave relative to the peripheral region.

7. The forward warhead of claim 1, wherein said containment structure and explosive have a forward section with a diameter conformal with said case and have a tapered aft section that tapers to a reduced diameter to define a tapered void space between the case and the containment structure, said initiator positioned aft of the explosive to initiate detonation of the explosive at the end of the taper.

8. The forward warhead of claim 7, wherein detonation of the explosive produces a pressure wave that propagates forward through the tapered explosive to expel the fragments in the forward-firing pattern, wherein the taper is optimized to maximize the void space without reducing the total explosive energy imparted to the fragmentation layer.

9. The forward firing warhead of claim 7, further comprising a base plate aft of the explosive.

10. The forward firing warhead of claim 1, wherein said pulverized case material has a mass efficiency no greater than 1%, said expelled fragments from said forward-firing fragmentation assembly has a mass efficiency of at least 70%.

11. The forward firing warhead of claim 1, wherein said forward-firing fragmentation assembly expels fragments in said forward-firing pattern in a half-angle of between 3 and 45 degrees about a long axis of the warhead.

12. The forward firing warhead of claim 1, wherein the pulverized case material has a lethality radius to humans no greater than the lethality radius due to the gas blast of the explosive.

13. A forward firing warhead, comprising:

a case having a forward section with an opening;

an explosive containment structure inside the case, said containment structure having a forward section with a diameter conformal with said forward section of the case and having a tapered aft section that tapers to a reduced diameter to define a tapered void space between the case and the containment structure, said case and containment structure formed of materials that are pulverized upon detonation with a mass efficiency no greater than 1%;

an explosive in the explosive containment structure, said explosive having a dome-shaped end, a forward section with a diameter in conformal contact with an inner surface of said containment structure and an aft section that tapers to said reduced diameter in conformal contact with the inner surface of said containment structure eliminating metal fragments thrown radially from the forward section of the warhead;

an initiator aft of the explosive to initiate detonation of the explosive at the end of the taper to produce a pressure wave; and a forward-firing fragmentation assembly including a dome-shaped layer of pre-formed fragments positioned in the opening forward of the explosive and at least approximately conformal with the dome-shape end of the explosive, the curvature of said dome-shape layer approximately conforming to the shape of the front of the pressure wave that reaches the fragmentation to expel said pre-formed fragments in a forward-firing pattern with a mass efficiency of at least 70% upon detonation of the explosive.

14. The forward warhead of claim 13, wherein the pressure wave propagates forward through the tapered explosive to expel the pre-formed fragments in the forward-firing pattern, wherein the taper is optimized to maximize the void space without reducing the total explosive energy imparted to the dome-shaped layer of pre-formed fragments.

15. A forward firing warhead, comprising:

a case;

an explosive in the case;

an initiator to initiate detonation of the explosive to produce a pressure wave; and a forward-firing fragmentation assembly including a dome-shaped fragmentation layer positioned forward of the explosive, the curvature of said dome-shaped fragmentation layer approximately conforming to the shape of the front of the pressure wave that reaches the fragmentation assembly to expel fragments in a forward-firing pattern.

* * * * *